US007870847B2

(12) United States Patent
Eisenmenger

(10) Patent No.: US 7,870,847 B2
(45) Date of Patent: Jan. 18, 2011

(54) FUEL INJECTOR COMPRISING A PRESSURE-COMPENSATED CONTROL VALVE

(75) Inventor: Nadja Eisenmenger, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 83 days.

(21) Appl. No.: 12/302,093

(22) PCT Filed: Mar. 19, 2007

(86) PCT No.: PCT/EP2007/052551

§ 371 (c)(1),
(2), (4) Date: May 1, 2009

(87) PCT Pub. No.: WO2007/128613

PCT Pub. Date: Nov. 15, 2007

(65) Prior Publication Data

US 2009/0308354 A1 Dec. 17, 2009

(30) Foreign Application Priority Data

May 10, 2006 (DE) ..... 10 2006 021 741

(51) Int. Cl.
*F02M 57/02* (2006.01)

(52) U.S. Cl. ..... 123/446; 123/458; 239/88

(58) Field of Classification Search ..... 123/446, 123/458, 500, 501; 239/88–96
See application file for complete search history.

(56) References Cited

U.S. PATENT DOCUMENTS

| | | | | |
|---|---|---|---|---|
| 5,947,380 | A | 9/1999 | Coldren et al. | |
| 6,085,719 | A * | 7/2000 | Heinz et al. | 123/300 |
| 6,837,221 | B2 * | 1/2005 | Crofts et al. | 123/467 |
| 7,213,775 | B2 * | 5/2007 | Ricco et al. | 239/533.2 |
| 2006/0000453 | A1 | 1/2006 | Ricco et al. | |

FOREIGN PATENT DOCUMENTS

| | | | |
|---|---|---|---|
| DE | 3802648 | A1 | 8/1989 |
| DE | 19839572 | A1 | 5/1999 |
| EP | 1612398 | A1 | 1/2006 |
| EP | 1612403 | A1 | 1/2006 |

* cited by examiner

*Primary Examiner*—Erick Solis
(74) *Attorney, Agent, or Firm*—Ronald E. Greigg

(57) ABSTRACT

The invention relates to an injector for injecting fuel into a combustion chamber of an internal combustion engine. According to the invention, an injection valve member, which opens or closes at least one injection opening, is controlled by a control valve. The control valve opens or closes a connection from a control chamber into a fuel return line by the positioning of a closing element in a seat or by the opening of the seat. A bore is embodied in the closing element, and a pin is received in the bore. The diameter of the bore essentially corresponds to the diameter of the seat. The pin is supported on one side against a pressure rod, against a spring seat, or against the injector housing.

15 Claims, 5 Drawing Sheets

FUEL INJECTOR COMPRISING A PRESSURE-COMPENSATED CONTROL VALVE

CROSS-REFERENCE TO RELATED APPLICATION

This application is a 35 USC 371 application of PCT/EP 2007/052551 filed on Mar. 19, 2007.

BACKGROUND OF THE INVENTION

1. Field of the Invention

The invention relates to an injector for injecting fuel into a combustion chamber of an internal combustion engine, in which an injection valve member, which opens or closes at least one injection opening, is triggered by a control valve.

2. Description of the Prior Art

An injector for injecting fuel into a combustion chamber of an internal combustion engine, in which an injection valve member is triggered via a magnet-driven control valve, is known for instance from European Patent Disclosure EP-A 1 612 403. With the aid of the control valve, an outflow throttle restriction from a control chamber into the fuel return can be closed or opened. The control chamber is defined on one side by a control piston, with which an injection valve member is triggered that opens or closes at least one injection opening into the combustion chamber of the engine. The outflow throttle restriction is received in a body that, on the side remote from the control chamber, is provided with a tapering valve seat. A closing element, which is connected to the armature of the magnet valve, is displaceable into this valve seat. To that end, an edge is embodied on the closing element, and this edge is displaced against the conically shaped seat. The closing element moves on an axial rod, and this rod is integrally connected to the body in which the outflow throttle restriction is embodied. In order for the valve to close in fluid -tight fashion, it is necessary that high-precision surfaces be made and that a high-precision fit of the closing element on the axial rod be provided, in order to prevent the closing element from tumbling and as a result becoming canted, causing the seat not to be completely closed.

ADVANTAGES AND SUMMARY OF THE INVENTION

The control valve of the injector according to the invention opens or closes a communication from a control chamber into a fuel return by displacing a closing element into a seat or uncovering the seat. The seat is preferably embodied as a polished flat seat, and the closing element includes a polished face which is displaceable into the seat, and in the closing element, a bore is embodied, in which a pin is received. The diameter of the bore essentially corresponds to the diameter of the flat seat. The advantage of the embodiment according to the invention is that, because the diameter of the bore essentially corresponds to the diameter of the flat seat, no axial pressure forces act on the closing element. However, instead of being embodied as a flat seat, the seat can assume any other shape as well with which essentially no axial forces act on the closing element. This requires that the closing element be embodied annularly, so that there is no face on which pressure forces can act in the axial direction.

In general, the control valve of the injector embodied according to the invention is a pressure-balanced 2/2-way magnet valve. However, instead of the magnet for triggering the control valve, any other actuator known to one skilled in the art is also conceivable. For instance, a control valve which is actuated by a piezoelectric actuator or any other actuator that allows rapid actuation can also be used.

In a preferred embodiment, the closing element on which the polished face is embodied that is displaceable into the seat is a valve needle. The bore in which the pin is received is embodied in the valve needle. The pin is preferably braced by one end against a pressure rod or the injector housing. The fuel pressure acting on the pin is thus output to the injector housing or to the pressure rod. The pressure rod is preferably embodied such that it is also braced on the housing. Inside the bore, no pressure force acts in the axial direction on the valve needle. The pin here serves merely to absorb pressure. The valve needle is guided in a polished armature guide. To that end, the armature guide surrounds the valve needle on its outer circumference. The advantage of this arrangement is that the guide of the valve needle need not simultaneously act as a sealing element. Moreover, because the valve needle is guided on its outside in the armature, a larger dimensioning of the guide diameter is possible. This simplifies the manufacture of the guide. A further advantage of the guidance of the valve needle on its outer circumference is that sealing off the outflow throttle restriction is decoupled from the guidance of the valve needle. The sealing off is effected on the one hand via the flat seat and on the other via a sealing gap, which is embodied between the bore and the pin, while the guidance of the valve needle is effected on its outer circumference, where no sealing off from fuel that is at system pressure is necessary. Particularly at high fuel pressures, a smaller diameter of the sealing gap is necessary, to reduce incident leakage. Since for sufficiently precise guidance of the valve needle, the guide must be polished, the minimum possible diameter is predetermined by the machining tools. By separating the valve needle guidance from the sealing off from the fuel, the seal diameter can be made substantially less than the diameter of the polished guide. As a result, the leakage flow is reduced, compared to a guide that also functions simultaneously as a sealing face.

In a further embodiment, the control valve is a magnet valve, and the polished face, which is displaceable into the flat seat in order to open or close the communication from the outflow throttle restriction into the fuel return, is embodied on the armature of the magnet valve. An advantage of this embodiment is that one additional valve needle can be dispensed with. As a result, fewer parts made to high precision are needed, making for cost savings. A further advantage is that only the mass of the armature has to be moved, making faster switching possible.

In one embodiment, the armature is guided with an extension in an armature guide that is embodied on a valve piece and surrounds the armature. The bore, in which the pin is guided that absorbs the pressure force acting in the axial direction and transmits it to the housing, is embodied in the extension. In this embodiment as well, the bore in the extension of the armature serves only to seal off the outflow throttle restriction from fuel at system pressure, by means of the pin received in it, and to absorb the pressure force. The guidance is decoupled from the sealing function and takes place on the outer circumference of the extension on the armature. A further advantage of this embodiment is that as a result of the guidance on the outer circumference of the extension, the latter is larger in size and is thus easier to manufacture.

In a further embodiment, the pin that is received in the bore is a guide pin, and the bore is embodied in the armature. In this embodiment as well, the polished face which is displaceable into the flat seat is embodied on the armature. Because of the guidance of the armature on the guide pin, it is possible to embody the armature with a shorter guide length and thus to make the injector more compact. Moreover, in that case, only one precise fit is required, since an additional guide is dispensed with. The guide pin simultaneously serves to absorb the pressure force that acts in the axial direction. In this way, it is assured that the armature is pressure-balanced.

In a further embodiment, the armature on which the polished face that is displaceable into the polished flat seat for closing or opening the outflow throttle restriction is embodied is guided with a guide on the outer circumference in the inner magnet core. The bore in which the pin is received that absorbs the pressure force acting in the axial direction is embodied in the guide. In this embodiment as well, because the armature acts as a closing element, one valve needle is not necessary. In addition, because the armature is guided in the inner magnet core, the guidance function is decoupled from the sealing function. At the same time, this also makes it possible for the injector to be made compact, since an additional guide length between the magnet and the valve piece is unnecessary.

BRIEF DESCRIPTION OF THE DRAWINGS

The invention will be described in further detail below in conjunction with the drawings: in which.

DESCRIPTION OF THE PREFERRED EMBODIMENTS

Figure 1:
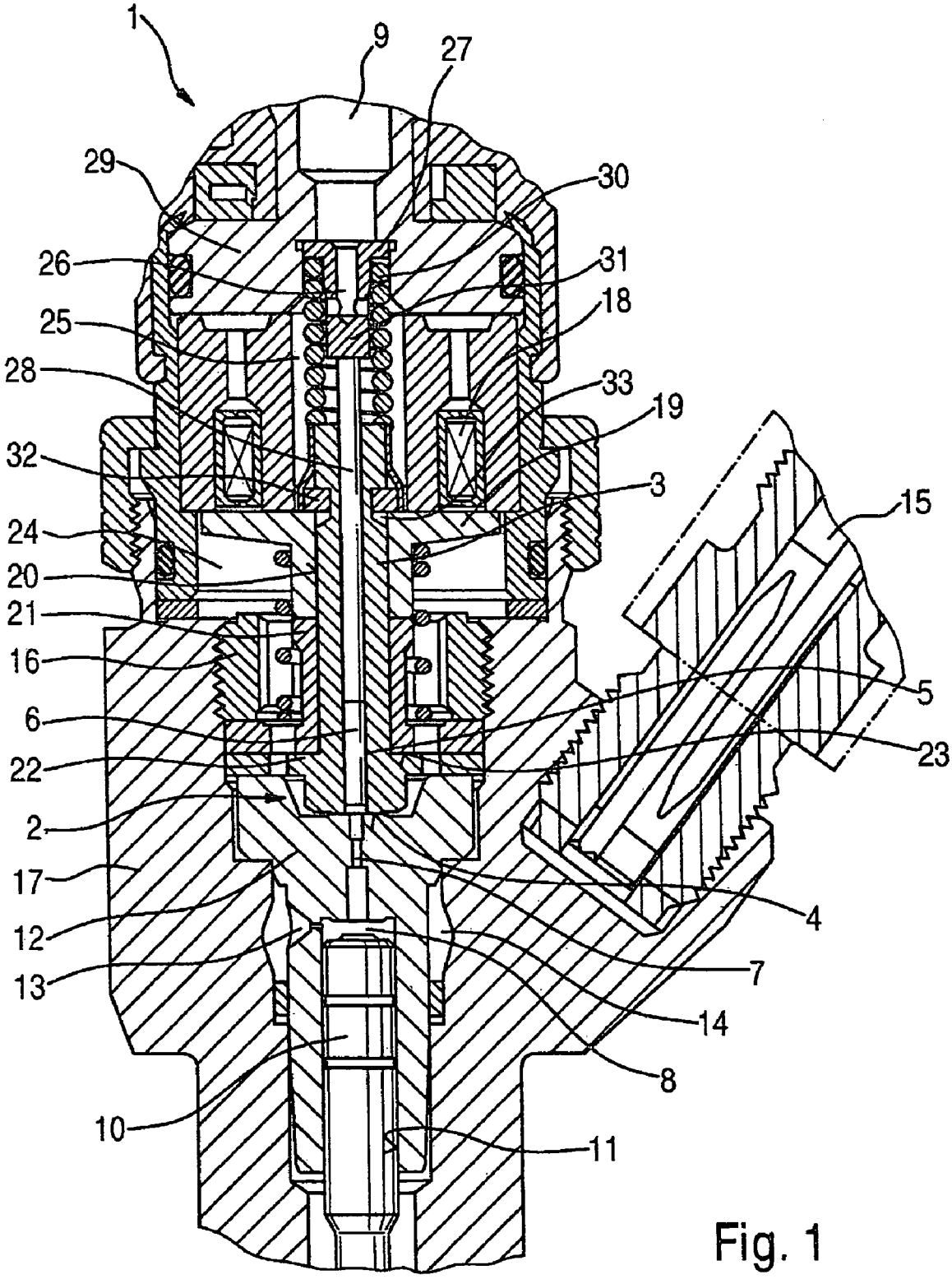
FIG. 1 shows a detail of an injector with a control valve.

FIG. 1 shows a detail of a fuel injector with a control valve, in which a valve seat in the form of a polished face is embodied on a valve needle.

A fuel injector 1 embodied according to the invention includes a control valve 2, which is embodied as a 2/2-way magnet valve. With the control valve 2 shown here, the hydraulic forces are minimized via a pressure equalization. As a result, the spring force can be reduced, with at the same time a shorter stroke and a larger cross-sectional area. This makes shorter switching times and better dynamics possible, compared to the valves known from the prior art.

This is attained in that a bore 5 is embodied in a valve needle 3, which needle is displaceable into a seat 4. A pressure pin 6 is received in the bore 5. So that no pressure forces acting in the axial direction will act on the valve needle 3, the diameter of the bore 5 is essentially equal to the diameter of the seat 4. By means of the seat 4, an outflow throttle restriction 7 can be closed or opened, by way of which restriction fuel can flow from a control chamber 8 into a low-pressure region, not shown here, via a return 9. The control chamber 8 is defined on one side by a control piston 10. Via the control piston 10, an injection valve member, not shown here, which opens or closes at least one injection opening into a combustion chamber of an internal combustion engine, can be trigged. The control piston 10 is guided in a bore 11 in a valve piece 12. Via an inlet throttle restriction 13, fuel can flow out of an annular chamber 14, surrounding the vavle piece 12, into the control chamber 8. The fuel reaches the annular chamber 14 via a fual conduit, not shown, from the fuel inlet 15. The fuel inlet 15 communicates with a high-pressure reservoir, also not shown here, in which fuel at system pressure is stored.

The valve piece 12 is screwed into an injector body 17 with the aid of a valve tightening screw 16.

The control valve 2 is triggered via a magnet 18, which is embodied as an electromagnet. As soon as current is supplied to the magnet 18, a magnetic field develops, which acts on an armature 19. A bore 20 in which the valve needle 3 is guided is embodied in the armature 19. The armature 19 is adjoined by a sleeve 21. The sleeve 21 acts as a guide for the valve needle 3. To adjust the valve stroke, a collar is embodied on the sleeve 21, and the collar rests on a disk 38, which in turn rests on the valve piece 12. The combination of the collar on the sleeve 21, the disk 38, and the valve piece is screwed using the valve tightening screw. The valve stroke is determined by the thickness of the disk 38. For limiting the stroke, the widened portion 22 of the valve needle 3 strikes an end face 23 of the sleeve 21.

The armature 19 is received in an armature chamber 24, into which, when the control valve 2 is open, the fuel flows out of the control chamber 8. From the armature chamber 24, via a spring chamber 25 and a bore 26 in a spring plate 27, the fuel reaches the return 9.

By its end diametrically opposite the control chamber 8, the pin 6 is braced against a pressure rod 28.

The pressure force acting on the pin 6 is transmitted to the pressure rod 28. With the end diametrically opposite the pin 6, the pressure rod 28 is braced against the spring plate 27. As a result, the pressure force is transmitted further to the spring plate 27. The spring plate 27 is in turn braced on an outlet stub 29, with which the injector housing is closed. As a result, the pressure force transmitted from the pin 6 to the spring plate 27 via the pressure rod 28 is transmitted to the outlet stub 29 and thus to the housing. No pressure force acts in the axial direction on the valve needle 3, in the bore 5 of which the pin 6 and the pressure rod 28 are received.

In order to displace the valve needle 3 into its seat 4, a spring element 30 is received in the spring chamber 25, and this spring element displaces the valve needle 3 into its seat when the magnet 18 is not being supplied with current. To that end, the spring element 30 is preferably a spiral spring embodied as a compression spring. It is braced by one end against the valve needle 3 and by the other against the spring plate 27. The spring element 30 surrounds a peg 31, embodied on the spring plate 27, and the pressure rod 28.

To start the injection event, current is supplied to the magnet 18. As a result, a magnetic field develops, by which the armature 19 is attracted in the direction of the magnet 18. The armature 19 acts on a ring 32, which engages a groove 33 on the valve needle 3. As a result, the valve needle 3, together with the armature 19, is moved in the direction of the magnet 18. In the process, the valve needle 3 is guided in the sleeve 21. As soon as the valve needle 3, with its widened portion 22 strikes the end face 23 of the sleeve 21, the opening motion is terminated. From the control chamber 8, fuel at system pressure can flow away, via the outflow throttle restriction 7, the armature chamber 24, the spring chamber 25, and the return 9. The pressure in the control chamber 8 decreases. As a result, the control piston 10 is no longer pressure-balanced and moves into the control chamber 8. The result is a motion of the injection valve member, not shown here, in the direction of the control piston 10, causing the at least one injection opening to be opened and fuel to flow into the combustion chamber of the engine.

To terminate an injection event, the supply of current to the magnet 18 is terminated. The magnetic field breaks up. Thus the armature 19 is no longer attracted in the direction of the magnet 18. By the spring force of the spring element 30, the valve needle 3 is moved in the direction of the valve seat 4 and closes it. Fuel can no longer flow out of the control chamber 8 via the outflow throttle restriction 7. Fuel at system pressure flows into the control chamber 8, via the inlet throttle restriction 13 and the annular chamber 14 which is in communication with the fuel inlet 15. As a result, system pressure builds up again in the control chamber 8. By the pressure force that as a result acts on the control piston 10, this piston is moved in the direction of the injection valve member. The injection valve member is displaced into its seat again, and thus closes the at least one injection opening. This ends the injection event.

Figure 2:
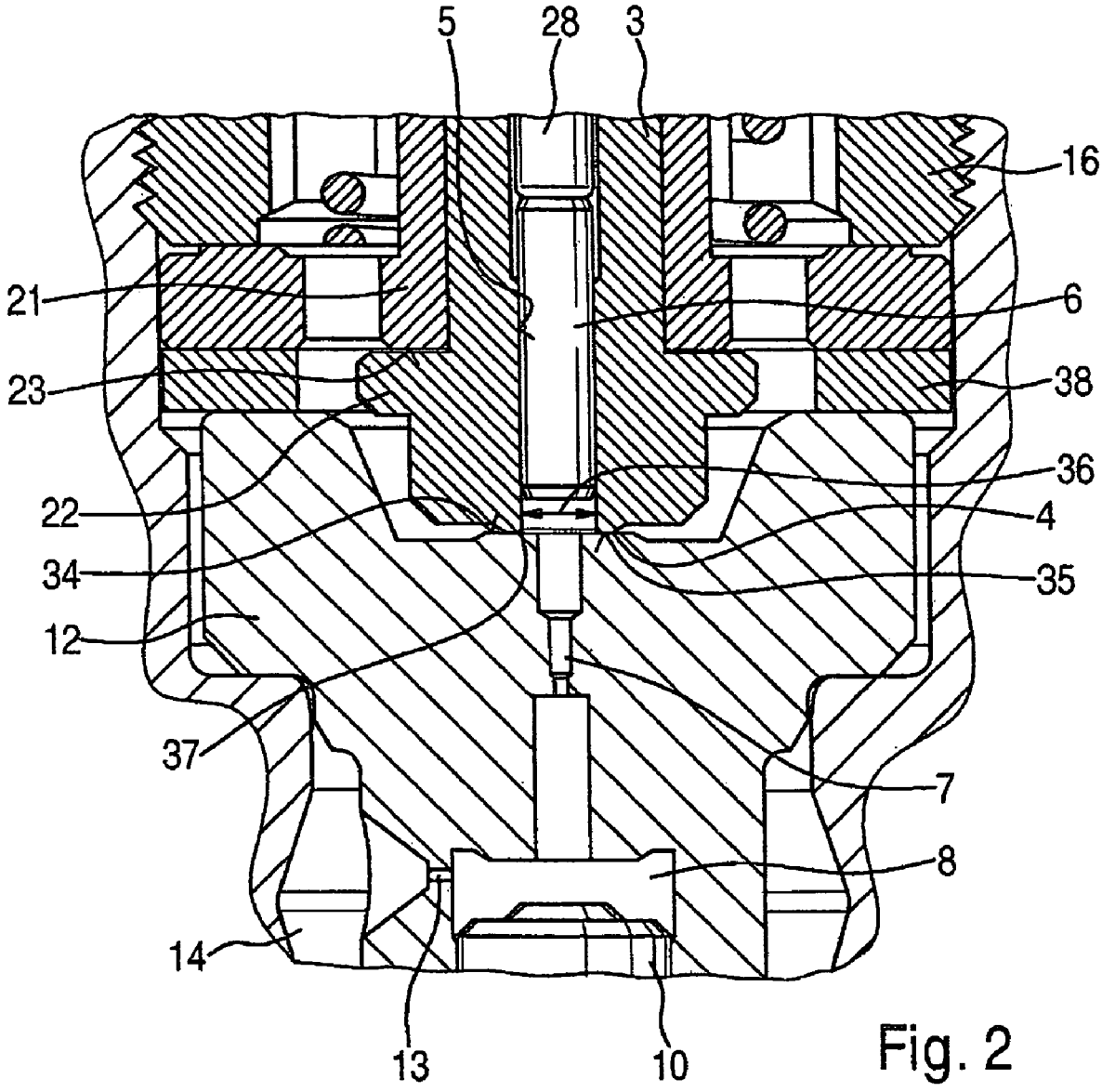
FIG. 2 shows an enlargement of the valve seat of FIG. 1.

In FIG. 2, the valve seat 4 is shown enlarged.

To close the outflow throttle restriction 7 tightly, a polished flat seat 34 is embodied on the valve piece 12. A polished face 35 is embodied on the valve needle 3 and is displaced against the polished flat seat 34, in order to close the outflow throttle restriction 7. Since the inside diameter 36 of the polished face 35 is equivalent to the diameter of the bore 5, no pressure force acts in the axial direction on the valve needle 3. However, it is possible for production reasons to make a chamfer 36 on the valve needle 3 by grinding. In this case, a lesser proportion of the pressure is exerted on the chamfer 36 in the axial direction. To prevent fuel from flowing out via the outflow throttle restriction 7 along the bore 5, the pin 6 is guided in the bore 5 with little guidance play. As a result, a seal forms by way of a narrow gap. However, the pin 6 serves only to seal off the bore 5 and to prevent any pressure force from acting in the axial direction on the valve needle 3. There is no provision for guidance of the valve needle 3 by the pin 6. The guidance of the valve needle 3 is instead effected in the sleeve 21. Because of the substantially greater inside diameter of the sleeve 21, this guidance can be more easily manufactured with the requisite surface quality than a corresponding guidance by means of the bore 5.

Figure 3:
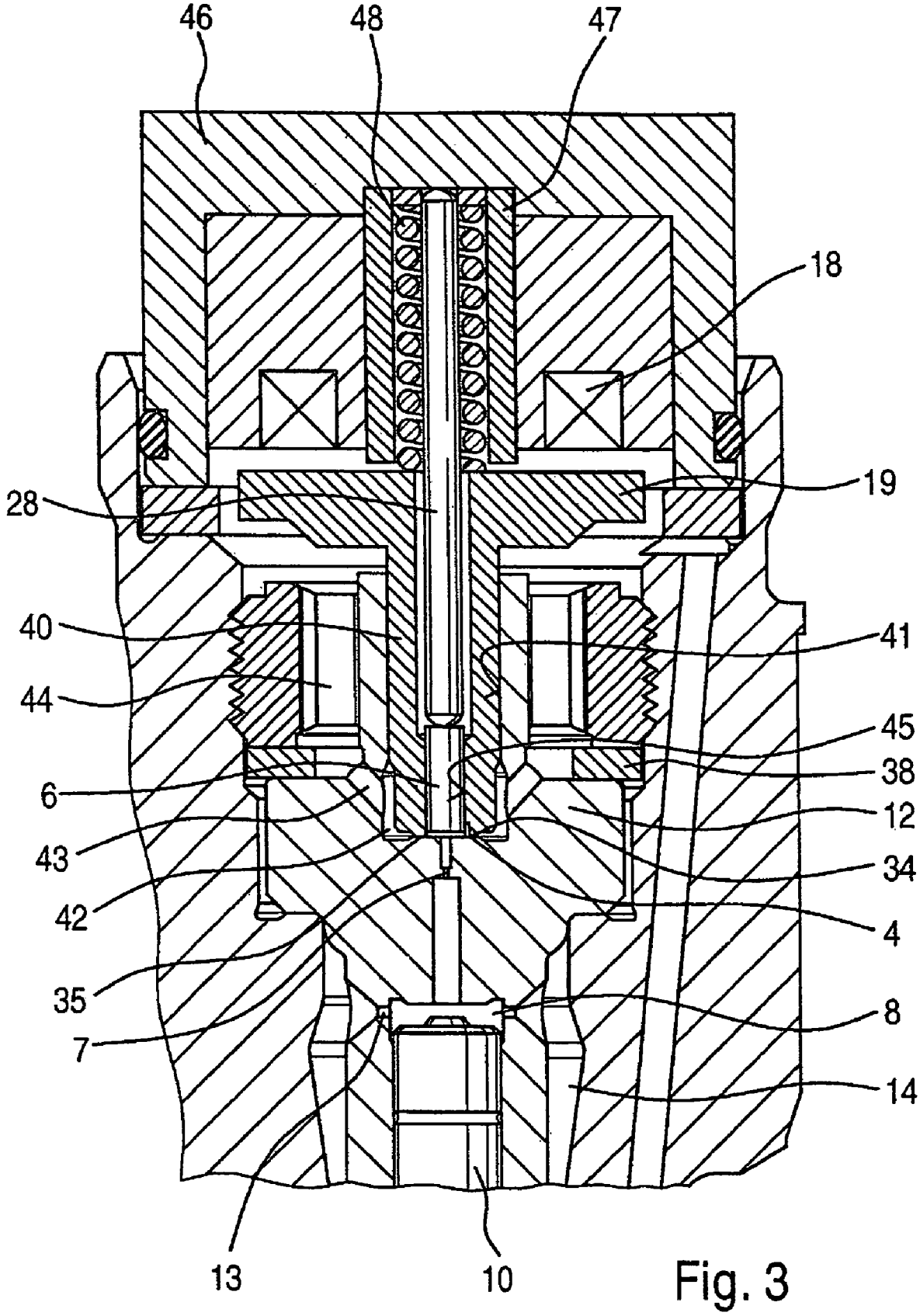
FIG. 3 shows a detail of an injector with a control valve, in which the valve seat is embodied on the armature.

FIG. 3 shows a detail of a fuel injector, in which the valve seat is embodied on the armature of a magnet valve.

In the embodiment shown in FIG. 3, the seat 4, with which the outflow throttle restriction 7 can be closed or opened, is embodied directly on an extension 40 on the armature 19. As a result, no valve needle is needed for closing or opening the outflow throttle restriction 7. The extension 40 is guided in an armature guide 41, which is embodied on the valve piece 12. The guidance takes place at the outer diameter of the extension 40, so that the armature guide 41 can be made suitably large. This facilitates the production of the armature guide 41. The armature guide 41 opens toward the outflow throttle restriction 7 into an inner valve chamber 42. This chamber communicates via a conduit 43 with an outer valve chamber 44. A bore 45 in which the pin 6 is guided is embodied in the extension 40. As in the valve needle 3 shown in FIG. 2, a polished face 35 is embodied on the extension 40 of the armature 19, and this face is displaced into a polished flat seat 34 on the valve piece 12 in order to close the outflow throttle restriction 7. The inside diameter of the bore 45 is precisely as large as the inside diameter of the polished face 35. As a result, no pressure force is exerted in the axial direction on the extension 40 and hence on the armature 19. The pressure force in the axial direction is absorbed by the pin 6, which is braced against the pressure rod 28. The pressure rod 28 in turn is braced on a housing cap 46, so that the pressure force is transmitted from the pin 6 to the housing cap 46 via the pressure rod 28.

To start the injection event, current is supplied to the magnet 18. As a result, the armature 19 is attracted in the direction of the magnet 18. In the interior of the magnet 18, a sleeve 47 is received that serves as a stroke stop. As soon as the armature 19 strikes the sleeve 47, the stroke motion is ended. As a result of the motion of the armature 19, the polished face 35 lifts out of the polished flat seat 34 and thus opens up a communication from the outflow throttle restriction 7 into the inner valve chamber 42. Thus fuel at system pressure flows out of the control chamber 8 via the outflow throttle restriction 7 into the inner valve chamber 42. Via the conduit 43, the fuel flows onward to reach the outer valve chamber 44, which communicates with a fuel return. As a result, the pressure in the control chamber 8 drops; the control piston 10 is moved in the direction of the control chamber 8, and the injection valve member opens.

For terminating the injection event, the current to the magnet 18 is stopped. With the aid of a spring element 48, which in the embodiment shown here is a compression spring embodied as a spiral spring, the armature 19 is moved back in the direction of the control chamber 8. As a result, the polished face 35 embodied on the extension 40 is displaced into the polished flat seat 34. The outflow throttle restriction 7 is closed. Via the inlet throttle restriction 13, fuel at system pressure flows out of the annular chamber 14, which communicates with a fuel inlet, into the control chamber 8, until system pressure prevails there. As a result of the increasing pressure in the control chamber 8, the control piston 10 is moved in the direction of the injection valve member. As a result, the injection valve member is displaced back into its seat and closes the at least one injection opening. The injection event is ended.

The spring element 48, with which the motion of the armature 19 in the direction of the control chamber 8 is reinforced, surrounds the pressure rod 28, in the embodiment shown here. Simultaneously, the spring element 48 is received in the sleeve 47.

Figure 4:
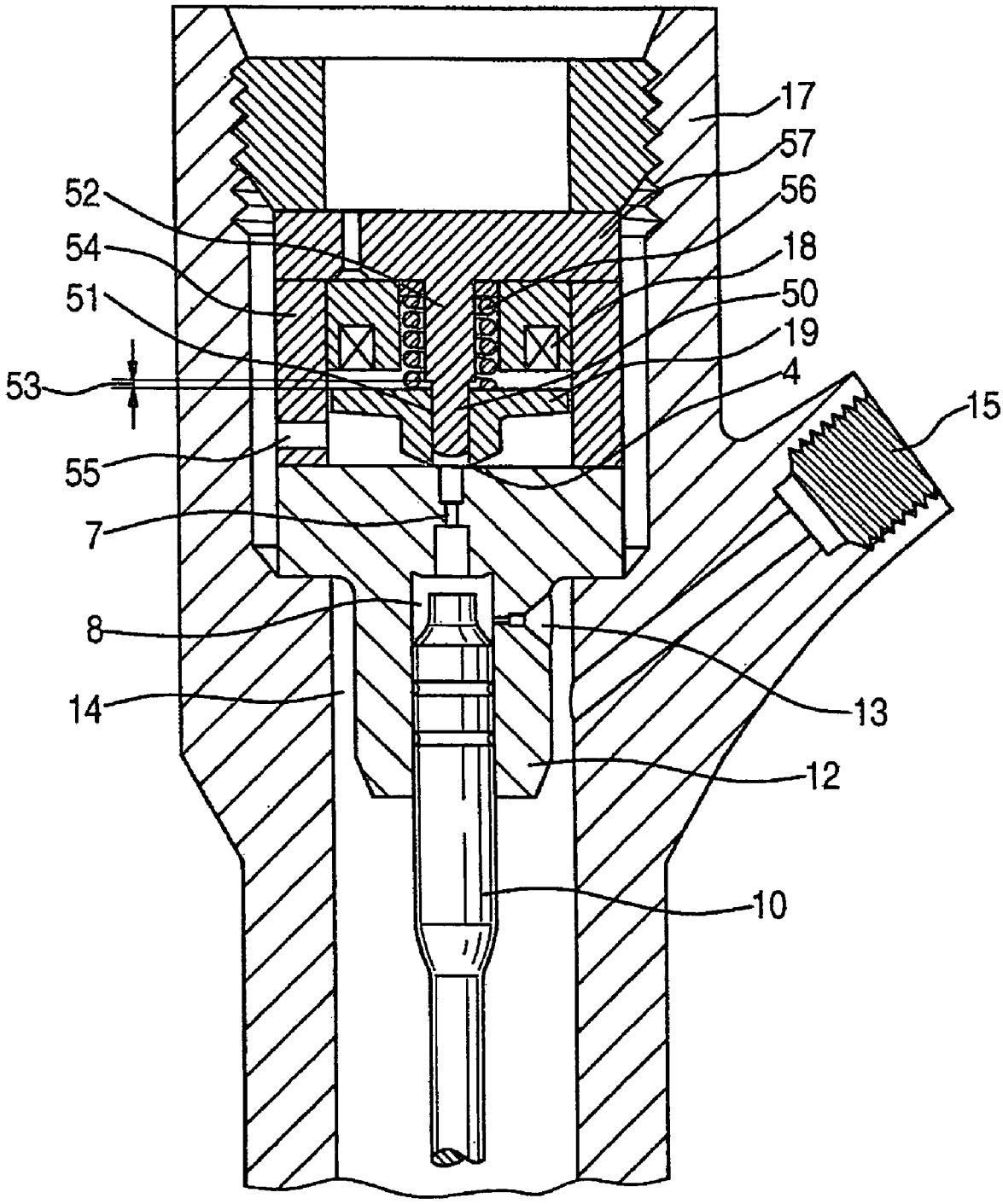
FIG. 4 shows a detail of a fuel injector with a control valve, in which the valve seat is embodied on the armature, in a second embodiment.

FIG. 4 shows a detail of a fuel injector with a control valve, in which the valve seat is embodied on the armature, in a second embodiment.

Unlike the embodiment shown in FIG. 3, in the embodiment shown in FIG. 4 the armature 19 is guided on a guide pin 50. The guide pin 50 is received in a guide gap 51, which in the embodiment shown here is embodied as a bore in the armature 19. The seat 4, with which the outflow throttle restriction 7 can be closed or opened, is embodied on the armature 19. The valve seat 4 is preferably embodied, as shown in FIG. 2, with a polished flat seat 34 on the valve piece 12 and with a polished face 35 on the armature 19. Because the inside diameter of the polished face 35 on the armature 19 has the same diameter as the bore 51, which with the guide pin 50 embodies the guide gap, no pressure force in the axial direction acts on the armature 19. This pressure acts solely on the guide pin 50. To limit the stroke 53 of the armature 19, a widened diameter 52 is embodied on the guide pin 50. The stroke 53 of the armature 19 is limited by the fact that the armature strikes the widened diameter 52. The guide pin 50, with the widened diameter 52, is solidly connected to a cap plate 57 that closes the magnet valve. The connection can be made by nonpositive or positive engagement, for example. The pressure pin 50 with the widened diameter 52 can also be embodied integrally with the cap plate 57.

In the embodiment shown here, the armature 19 and the magnet 18 are surrounded by an annular component 54. The stroke 53 of the armature 19 is adjusted by means of the height of the component 54 and the length of the widened diameter 52.

So that fuel can flow out into the return when the outflow throttle restriction 7 is open, the component 54 is preferably provided with apertures 55.

To start the injection event with the embodiment shown in FIG. 4, the magnet 18 is supplied with current. As a result, the armature 19 is moved in the direction of the magnet 18 until it strikes the widened diameter 52. The armature 19 lifts from the seat 4. As a result, a communication from the control chamber 8 to the fuel return, via the outflow throttle restriction 7 and the apertures 55, is opened up. Fuel flows out of the control chamber 8. As a result, the pressure in the control chamber 8 drops, and the control piston 10 moves into the control chamber 8. The injection valve member is lifted from its seat as a result and uncovers the at least one injection opening.

For ending the injection event, the current supply to the magnet 18 is stopped. With the aid of a spring element 56, which surrounds the widened diameter 52 and is preferably a spiral spring embodied as a compression spring, the armature 19 with the polished face 35 is displaced into the polished flat seat 34 and thus closes the outflow throttle restriction 7. Via the fuel inlet 15 and the inlet throttle restriction 13, fuel at system pressure flows into the control chamber 8. In the control chamber 8, the pressure rises to system pressure. As a result, the control piston 10 is moved in the direction of the injection valve member. This causes the injection valve member to be displaced back into its seat and to close the at least one injection opening.

Figure 5:
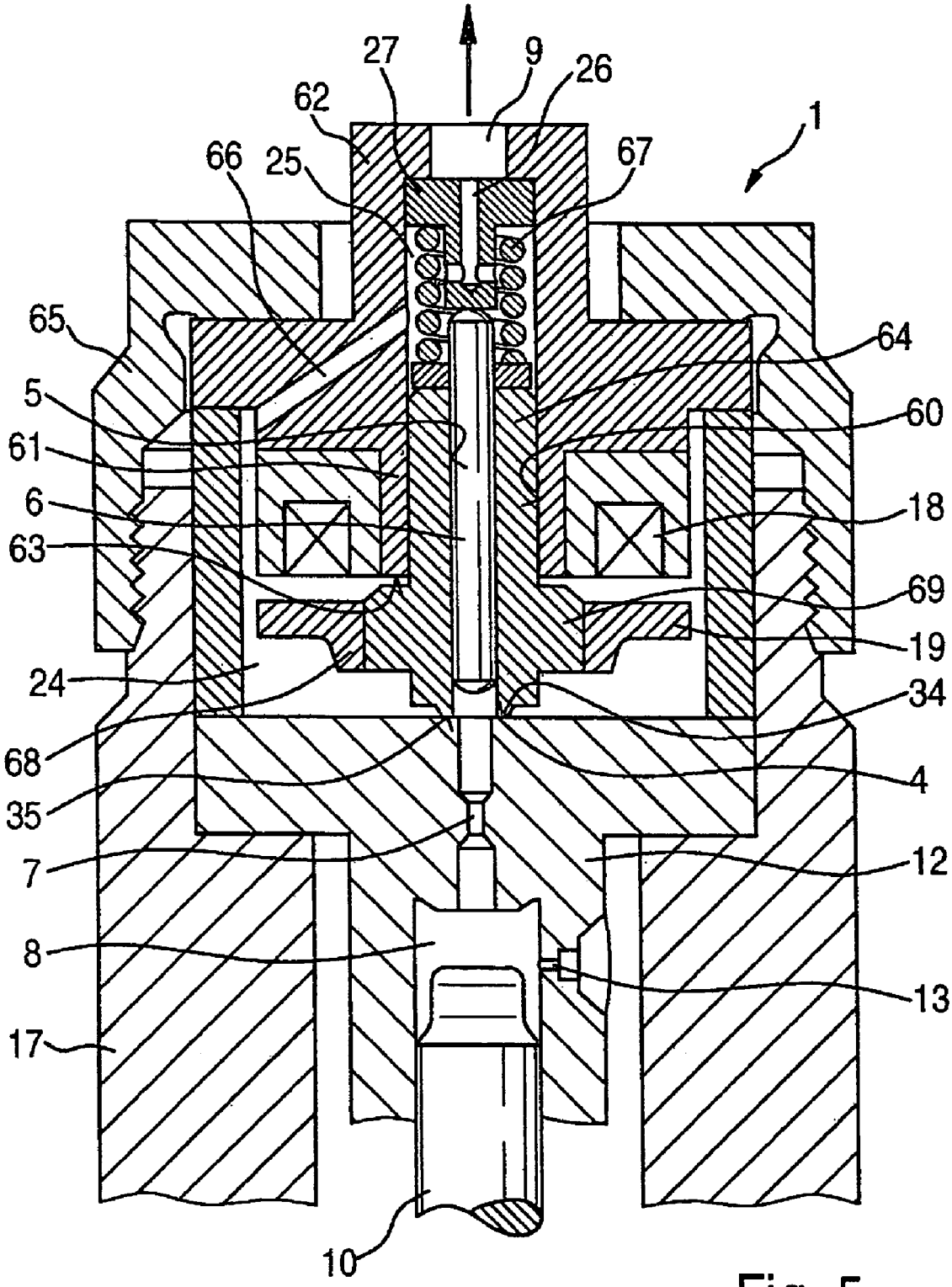
FIG. 5 shows a detail of a injector with a control valve, in which the valve seat is embodied on the armature, in a third embodiment.

FIG. 5 shows a detail of a injector with a control valve, in which the valve seat is embodied on the armature, in a third embodiment.

The fuel injector 1 shown in FIG. 5 differs from the injector shown in FIG. 4 in that the armature 19 is guided not via a guide pin 50 but rather in an armature guide 60, which is embodied in an inner magnet core 61. In the embodiment shown here, the inner magnet core 61 is embodied as an annular extension on an upper housing part 62, with which the injector is closed. The inner magnet core 61 is surrounded by the magnet 18. At the same time, the inner magnet core 61 serves as a stroke stop 63, for limiting the stroke of the armature 19. A sleevelike extension 64, which is guided in the armature guide 60, is embodied on the armature 19.

The upper housing part 62 is retained on the injector body 17 with the aid of a lock nut 65.

To start the injection event, current is supplied to the magnet 18. As a result, the armature 19 moves in the direction of the magnet, causing the polished face 35 embodied on the armature to lift out of the polished flat seat 34 and thus to uncover the seat 4. Fuel can flow out of the control chamber 8 into the armature chamber 24 via the outflow throttle restriction 7. As a result, the pressure drops in the control chamber 8, and the control piston 10 is moved into the control chamber 8, causing the injection valve member to uncover the at least one injection opening. From the armature chamber 24, the fuel flows via a conduit 66 into the spring chamber 25 and from there, via a bore 26 in the spring plate 27, into the return 9.

To end the injection event, the current supply to the magnet 18 is stopped. The armature 19 is displaced with the polished face 35 into the polished flat seat 34 and thus closes the outflow throttle restriction 7. The pressure in the control chamber 8 rises again and thus moves the control piston 10 in the direction of the injection valve member. As a result, the injection valve member is displaced back into its seat and it closes the at least one injection opening.

For reinforcing the motion of the armature 19, a spring element 67, which is preferably a spiral spring embodied as a compression spring, is received in the spring chamber 25. By the spring force of the spring element 67, which is braced by one end against the sleevelike extension 64 on the armature 19 and by its other end on the spring plate 27, the motion of the armature 19 in the direction of the flat seat 34 is reinforced. The pin 6 absorbs the system pressure exerted via the outflow throttle restriction 7. This pin is braced against the spring plate 27, so that the pressure force exerted by the pressure on the pin 6 is output to the upper housing part 62 via the spring plate 27. Because the bore 5 in which the pin 6 is guided is embodied with the same diameter as the inner diameter of the polished face 35, no pressure force is exerted in the axial direction on the armature 19.

The armature 19 with the sleevelike extension and with the polished face 35 can be embodied in one piece, or as shown in FIG. 5, in two parts. To that end, on a component, which the sleevelike extension 64 and the polished face 35 is connected directly to an armature plate 19. For stroke limitation, an enlarged portion 69 is embodied on the component which includes the sleevelike extension 64 and the polished face 35, and this enlarged portion, when the magnet is supplied with current and the seat 4 is thus opened, strikes the stroke stop 63.

Instead of the embodiment shown in FIGS. 1 through 5, in which the seat 4 is embodied as a flat seat, the seat can also assume any arbitrary other shape with which essentially no axial pressure forces act on the seat. This is always the case, for example, whenever the closing element is embodied annularly.

Besides the embodiments shown here, in which the pressure pin 6 is braced against the pressure rod 28, which in turn is braced against the spring plate, it is also possible for the pressure pin 6 to be braced directly against the injector housing. It is furthermore possible as well for the pressure pin 6 or the pressure rod 28 to be embodied integrally with the injector housing. In addition, the pressure pin 6 or the pressure rod 28 can also be graduated, or in other words embodied with a plurality of different diameters.

The foregoing relates to the preferred exemplary embodiments of the invention, it being understood that other variants and embodiments thereof are possible within the spirit and scope of the invention, the latter being defined by the appended claims.

The invention claimed is:

1. An injector for injecting fuel into a combustion chamber of an internal combustion engine, having an injection valve member, which opens or closes at least one injection opening, the valve member being triggered by a control valve, and the control valve opening or closing a communication from a control chamber into a fuel return by displacing a closing element into a seat or uncovering the seat, wherein in the closing element, a bore is embodied, in which a pin is received, and a diameter of the bore essentially corresponds to a diameter of the seat, and the pin is braced by one end against a pressure rod, against a spring plate, or against a housing of the injector.

2. The injector as defined by claim 1, wherein the control valve is a magnet valve or is triggered by a piezoelectric actuator.

3. The injector as defined by claim 1, wherein the closing element is a valve needle, on which a polished face is embodied.

4. The injector as defined by claim 2, wherein the closing element is a valve needle, on which a polished face is embodied.

5. The injector as defined by claim 3, wherein the valve needle is guided in a polished armature guide.

6. The injector as defined by claim 4, wherein the valve needle is guided in a polished armature guide.

7. The injector as defined by claim 1, wherein the seat is embodied as a polished flat seat, and the closing element includes a polished face which is displaceable into the seat.

8. The injector as defined by claim 2, wherein the seat is embodied as a polished flat seat, and the closing element includes a polished face which is displaceable into the seat.

9. The injector as defined by claim 3, wherein the seat is embodied as a polished flat seat, and the closing element includes a polished face which is displaceable into the seat.

10. The injector as defined by claim 5, wherein the seat is embodied as a polished flat seat, and the closing element includes a polished face which is displaceable into the seat.

11. The injector as defined by claim 2, wherein the closing element is an armature of the magnet valve, on which a polished face is embodied.

12. The injector as defined by claim 11, wherein the armature is guided with an extension in an armature guide that is embodied on a valve piece and that surrounds the armature, and the bore in which the pin is guided is embodied in the extension.

13. The injector as defined by claim 11, wherein the pin that is received in the bore is a guide pin, and the bore is embodied in the armature.

14. The injector as defined by claim 11, wherein the armature is guided in an armature guide in the inner magnet core by a sleevelike extension, and the bore in which the pin is received is embodied in the sleevelike extension.

15. The injector as defined by claim 14, wherein the pin is braced by one end against the injector housing.

* * * * *